US005464138A

United States Patent [19]

Rodriguez

[11] Patent Number: 5,464,138

[45] Date of Patent: Nov. 7, 1995

[54] SKI CARRYING DEVICE

[76] Inventor: Richard Rodriguez, 1161 Highland Dr., Vista, Calif. 92083

[21] Appl. No.: 317,915

[22] Filed: Oct. 4, 1994

[51] Int. Cl.[6] ..... A45F 3/10

[52] U.S. Cl. ..... 224/265; 224/201; 224/917; 280/814

[58] Field of Search ..... 224/265, 917, 224/908, 266, 271, 201, 205, 210, 273; 280/809, 814, 815; 248/312, 187; 24/482

[56] References Cited

U.S. PATENT DOCUMENTS

| | | | |
|---|---|---|---|
| 350,523 | 10/1886 | Bodley | 24/482 |
| 1,649,207 | 11/1927 | Anderson | 224/273 |
| 2,118,875 | 5/1938 | Windheim . | |
| 2,224,568 | 12/1940 | Altorfer . | |
| 2,536,394 | 1/1951 | Roberts | 224/201 |
| 3,090,621 | 5/1963 | Heimers et al. | 224/201 |
| 3,106,350 | 10/1963 | Wiltse et al. | 224/201 |
| 3,259,284 | 7/1966 | Olson . | |
| 3,330,573 | 7/1967 | Sieloff | 280/815 |
| 3,480,244 | 11/1969 | Iversen | 248/312 |
| 4,077,554 | 3/1978 | Goode | 280/814 |
| 4,139,132 | 2/1979 | Fairchild, Jr. | 224/201 |
| 4,308,982 | 1/1982 | Hall . | |
| 4,391,397 | 7/1983 | Taylor, Jr. | 224/265 |
| 4,673,118 | 6/1987 | Kronz . | |
| 4,792,073 | 12/1988 | Jacober . | |
| 4,863,083 | 9/1989 | Chen . | |
| 4,871,102 | 10/1989 | Wickersham . | |
| 4,943,820 | 7/1990 | Larock | 224/908 |
| 4,982,883 | 1/1991 | Ullal et al. . | |
| 5,141,251 | 8/1992 | Smith . | |
| 5,160,074 | 11/1992 | Coates . | |
| 5,222,641 | 6/1993 | Medeiros, Jr. | 224/265 |

FOREIGN PATENT DOCUMENTS

| | | | |
|---|---|---|---|
| 898864 | 4/1972 | Canada | 280/814 |

*Primary Examiner*—Henry J. Recla
*Assistant Examiner*—Gregory M. Vidovich
*Attorney, Agent, or Firm*—Loyal McKinley Hanson

[57] ABSTRACT

A device for carrying a pair of skis includes an elongated tube of rigid material having a first end portion, a second end portion, and a mid portion intermediate the first and second end portions. A ski mounting is provided on the second end portion for holding the pair of skis in an inclined position extending upwardly ahead of the user. The tube is shaped so that the first end portion is curved in a U-shaped configuration that fits over the shoulder of a user standing in an erect position, the mid portion extends downwardly from the first end portion ahead of the shoulder alongside the torso of the user to the second end portion, and the second end extends downwardly and rearwardly from the mid portion alongside the user in a position enabling the user to grip the second end portion while standing erect, thereby enabling the user to steady the skis and to adjust the incline of the skis by rotating the tube relative to the shoulder of the user by pushing and pulling the second end portion of the tube.

9 Claims, 2 Drawing Sheets

10
16
11
11A
11B
18
11E
12
14
14A
17
11C
13
15
11D
15A

SKI CARRYING DEVICE

BACKGROUND OF THE INVENTION

1. Technical Field

This invention relates generally to devices for carrying a pair of skis, and more particularly to a lightweight device that comfortably supports the pair of skis in an easily adjustable position on the user's shoulder.

2. Description of Related Art

Recall that skiers often transport their skis manually. They pick up the skis and carry them to another location where they set them back down. But bulky skiing attire and ski length can frustrate that effort, especially when the skier climbs stairs, moves in a crowd of other skiers, or otherwise negotiates around various obstacles in cold weather and over slippery terrain. Consequently, many skiers use a ski carrying device to facilitate the process.

Various ski carrying devices exist for that purpose, but some problems remain nevertheless. Some devices are just too complicated and expensive. Others include harnesses that are difficult to put on and remove, especially when outfitted in skiing attire. Some devices carry the skis behind the skier where they are out of sight. Some make it difficult to adjust ski position when climbing stairs or negotiating obstacles. Those things can severely limit usefulness and so skiers need an new and improved ski carrying device that more effectively overcomes those problems.

SUMMARY OF THE INVENTION

This invention solves the problems outlined above by providing a lightweight ski carrying device that comfortably supports the skis on the user's shoulder in an easily adjustable position. The device takes the form of an elongated tube (e.g., a three to four-foot length of one-inch diameter aluminum aircraft conduit) that has a curved section shaped to rest pivotally on the user's shoulder. The tube extends downwardly from the user's shoulder to a position alongside the user's torso (the hip region).

The tube supports the skis alongside the torso in an inclined position extending upwardly and forwardly. By gripping the tube with one hand, the user steadies the skis. By pushing and pulling on the tube while negotiating various terrain and obstacles, the user rotates the tube relative to the shoulder to adjust the position of the skis.

In terms of the claim language that is subsequently developed, a device for carrying a pair of skis includes an elongated tube of rigid material having a first end portion, a second end portion, and a mid portion intermediate the first and second end portions. A mounting is provided on the second end portion of the tube for holding the pair of skis on the shoulder of a user standing in an erect position so that the skis extend in an inclined position upwardly ahead of the user. The tube is shaped so that the first end portion of the tube is curved in a U-shaped configuration (i.e., inverted U-shaped configuration) that fits over the shoulder of a user, so that the mid portion of the tube extends downwardly from the first end portion ahead of the shoulder alongside the torso of the user to the second end portion of the tube, and so that the second end portion of the tube extends downwardly and rearwardly from the mid portion alongside the user in a position enabling the user to grip the second end portion while standing erect. With that arrangement, the user can grip the second end portion of the tube to steady the skis and then adjust the incline of the skis by pushing and pulling the second end portion so that the tube rotates relative to the shoulder of the user.

The ski carrying device may include a sleeve of material on the first end portion of the tube for padding and a sleeve of material on the second end portion of the tube for facilitating gripping of the second end portion. It may also include a cable attached to the tube for use in locking the device to some other structure. The mounting may include first and second brackets attached to the second end portion of the tube together with cooperating first and second straps. The following illustrative drawings and detailed description make the foregoing and other objects, features, and advantages of the invention more apparent.

DESCRIPTION OF THE PREFERRED EMBODIMENTS

Figure 1:
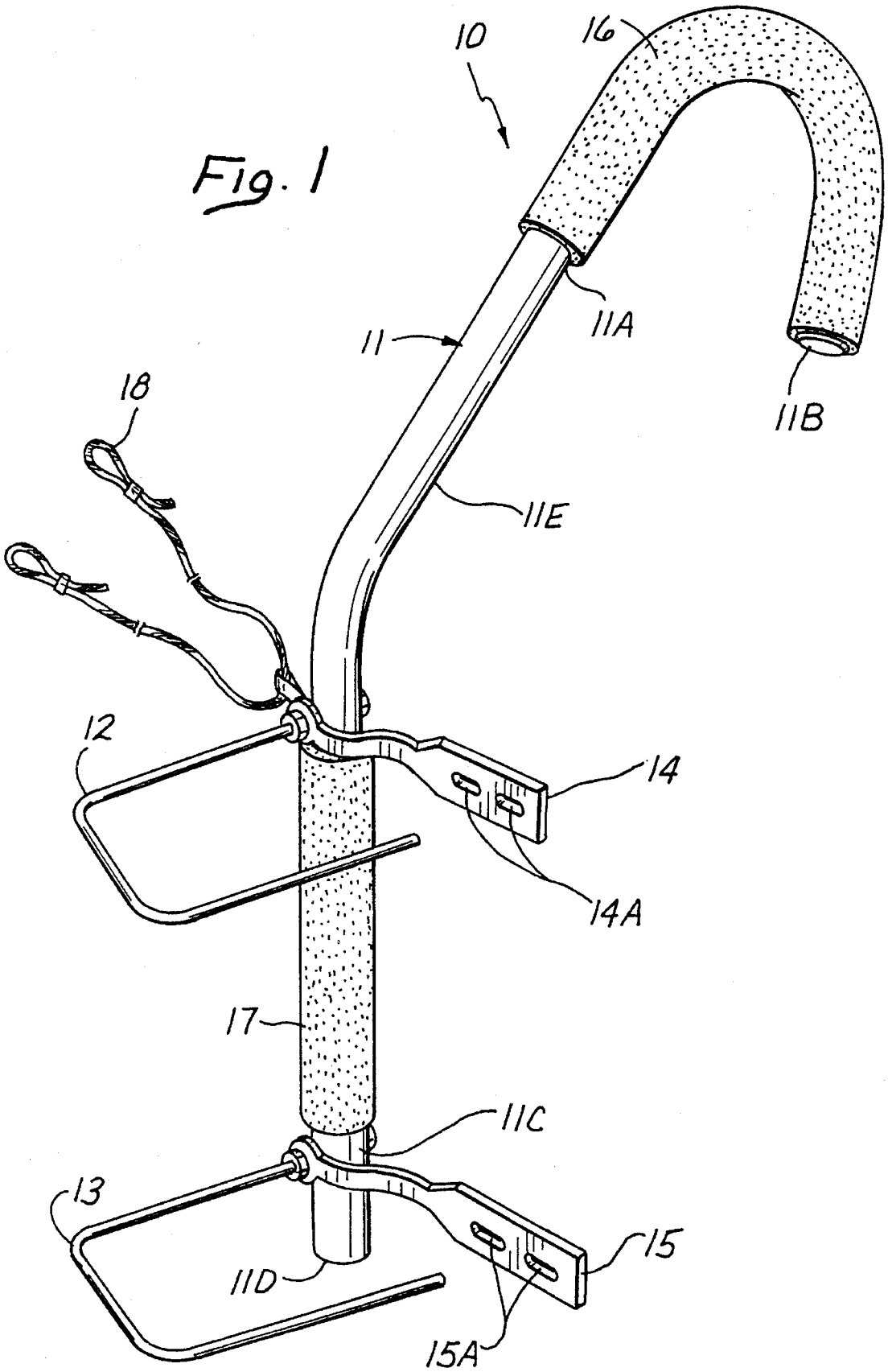
FIG. 1 of the drawings is a three dimensional view of a ski carrying device constructed according to the invention.

FIG. 1 of the drawings shows a ski carrying device 10 constructed according to the invention. Generally, it includes an elongated tube 11, a ski mounting in the form of first and second brackets 12 and 13 together with cooperating straps 14 and 15, first and second sleeves 16 and 17 for padding and gripping purposes, and a cable 18 for locking purposes. The illustrated tube of rigid material is a three to four-foot section of one-inch outside diameter aluminum conduit (e.g., aircraft tubing) that is bent into the illustrated shape. Solid and hollow tubes composed of other materials may be used within the inventive concepts disclosed, and they may be formed into the desired configuration by other techniques, including molding a plastic tube in the desired shape.

The tube 11 includes a first end portion 11A that extends to a first end 11B of the tube 11. The sleeve 16 covers a substantial part of the first end portion 11A. The tube 11 also includes a second end portion 11C that extends to a second end 11D of the tube 11, and a mid portion 11E that extends between the first and second end portions 11A and 11C. The sleeve 17 covers a substantial part of the second end portion 11C.

Figure 2:
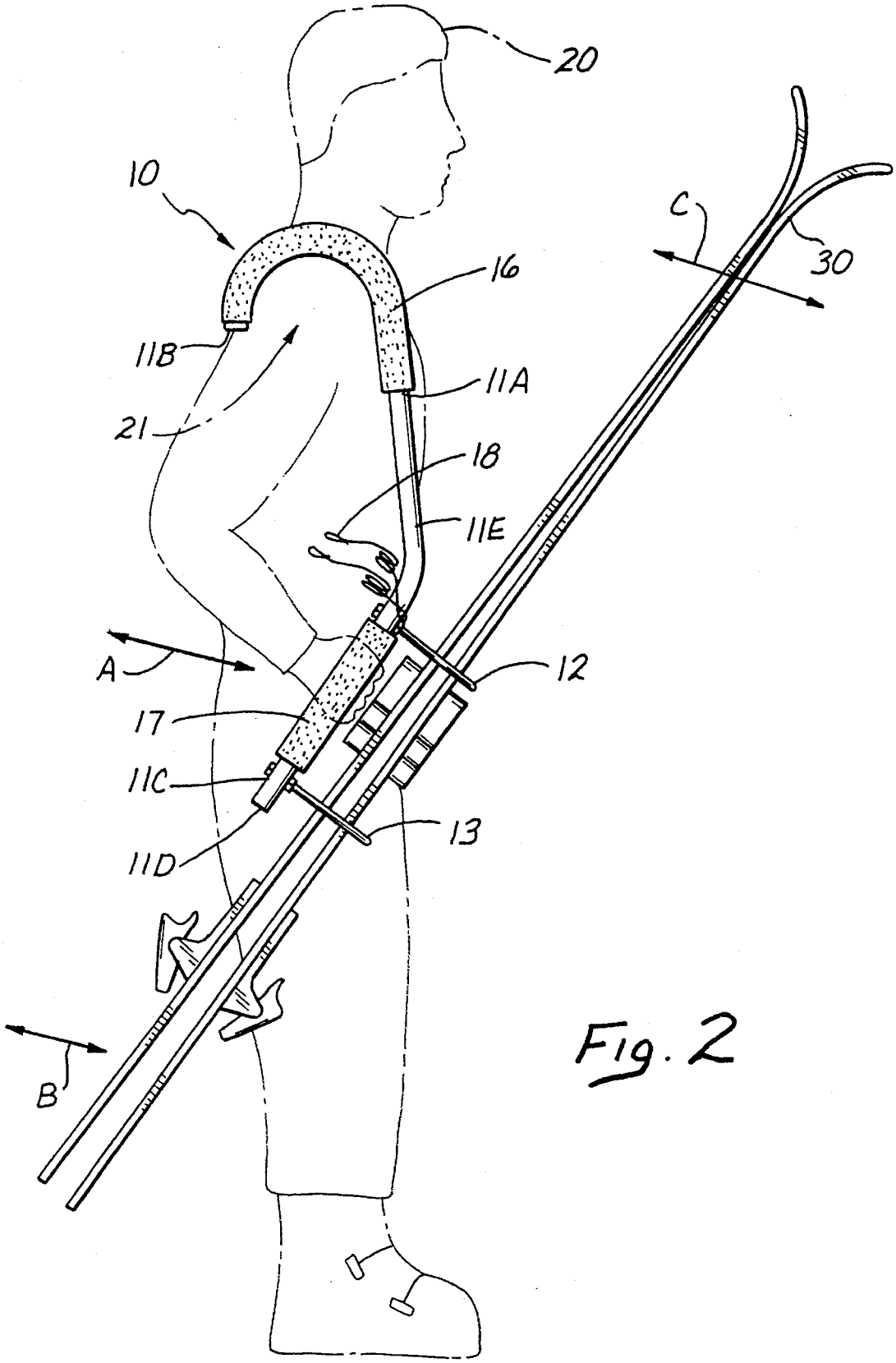
FIG. 2 is a side view of the device supporting a pair of skis on the left shoulder of a skier.

The first end portion 11A is curved in a U-shaped (i.e., inverted U-shaped configuration) that fits over the shoulder of a user, as depicted in FIG. 2 by a user 20 in phantom lines with the first end portion 11A over the right shoulder 21. The first end portion 11A extends on an arc of about 2.5–3.5 inch diameter and that enables it to fit over a ski jacket on the shoulder 21. The mid portion 11E extends downwardly from the first end portion ahead of the shoulder 21 alongside the torso of the user 20 to the second end portion 11C (e.g., about 12 inches below the top of the shoulder 21 for a average size six-foot adult). The second end portion 11C extends downwardly and rearwardly from the mid portion 11E about 12 inches alongside the user 20 in a position enabling the user 20 to grip the second end portion 11C (i.e., the sleeve 17 on the second end portion 11C) while standing erect. Thus, the longitudinal axis of mid portion 11E is approximately vertical and the longitudinal axis of the second end portion 11C is inclined rearwardly approximately forty degrees from the longitudinal axis of the mid portion. Of course, those dimensions and angles may be suitably scaled for different size users.

The brackets 12 and 13 are rigid members (e.g., ¼ inch diameter rods) that are suitably shaped and dimensioned (e.g., U-shaped) to receive a pair of skis 30 as shown in FIG. 2. The brackets 12 and 13 are suitably attached to the tube 11. For that purpose, each bracket may include a threaded end that bolts to the second end portion 11C of the tube 11. The straps 14 and 15 cooperate with the brackets 12 and 13 to hold the skis in the brackets. For that purpose, the illustrated straps 14 and 15 are stretchable rubber components with holes 14A and 15A (FIG. 1) that fit over the brackets 12 and 13 to hold the skis 30 in the position shown in FIG. 2. Other bracket configurations may be used instead within the broader inventive concepts disclosed.

The sleeves 16 and 17 may take the form of the commercially available handlebar covering frequently used on bicycles. They may be glued or otherwise suitably attached to the tube 11, or just be held by friction in a tight fit. The cable 18 may take the form of a plastic-covered bicycle locking cable. Preferably, it has loops through which to place a padlock and it is long enough so that the user can loop it through the bindings of the skis 30 and then around a post or other fixed structure to which the skis are being locked.

FIG. 2 illustrates how the user 20 positions the skis 30 while negotiating various obstacles. The user pushes and pulls on the device 10 with the right hand as depicted by the double-headed arrow A. That results in the skis 30 moving as depicted by the double-headed arrows B and C.

Thus, the invention provides a lightweight ski carrying device that comfortably supports the skis on the user's shoulder in an easily adjustable position. It is easily placed onto or removed from the shoulder. By gripping the tube with one hand, the user steadies the skis. By pushing and pulling on the tube while negotiating various terrain and obstacles, the user rotates the tube relative to the shoulder to adjust the position of the skis. Although an exemplary embodiment has been shown and described, one of ordinary skill in the art may make many changes, modifications, and substitutions without necessarily departing from the spirit and scope of the invention.

What is claimed is:

1. A ski carrying device for carrying a pair of skis, comprising:

an elongated tube of rigid material, the tube having a first end portion, a second end portion, and a mid-portion intermediate the first and second end portions; and mounting means on the second end portion of the tube for holding the pair of skis;

the tube being shaped so that the first end portion of the tube is curved in an inverted U-shaped configuration adapted to fit over the shoulder of a user standing in an erect position, so that the mid-portion of the tube extends downwardly from the first end portion ahead of the shoulder alongside the torso of the user to the second end portion of the tube, and so that the second end portion of the tube extends downwardly and rearwardly from the mid-portion alongside and adjacent the waist of the user in a position enabling the user to grip the second end portion while standing erect in order to steady the skis held in said mounting means;

the mounting means being arranged to hold the pair of skis on the second end portion in a position extending upwardly in an incline ahead of the user; and the first end portion of the tube being shaped so that it fits over the shoulder of the user loosely to enable the user to adjust the incline of the skis while gripping the second end portion by pushing and pulling the second end portion forwardly and rearwardly relative to the user alongside the torso of the user to thereby rotate the tube relative to the shoulder of the user to a position in which the skis are inclined as desired.

2. A ski carrying device as recited in claim 1, wherein the tube is a section of hollow aluminum tubing.

3. A ski carrying device as recited in claim 1, further comprising means in the form of a sleeve of material on the first end portion of the tube for padding.

4. A ski carrying device as recited in claim 1, further comprising means in the form of a sleeve of material on the second end portion of the tube for facilitating gripping of the second end portion.

5. A ski carrying device as recited in claim 1, further comprising means in the form of a cable attached to the tube for use in locking the device to a structure free of the ski carrying device.

6. A ski carrying device as recited in claim 1, wherein the ski mounting includes first and second brackets attached to the second end portion of the tube together with means in the form of first and second straps for cooperating with the brackets to hold the pair of skis.

7. A ski carrying device as recited in claim 6, wherein the brackets are U-shaped structures and the straps are composed of a stretchable material.

8. A device for carrying a pair of skis, comprising:

an elongated section of hollow aluminum tubing having two bends that form a first end portion of the tube, a second end portion of the tube, and a mid-portion of the tube intermediate the first and second end portions;

means in the form of a ski mounting on the second end portion of the tube for holding the pair of skis;

means in the form of a sleeve of material on the first end portion of the tube for padding; and means in the form of a sleeve of material on the second end portion of the tube for facilitating gripping of the second end portion;

the two bends in the tube resulting in the tube being shaped so that the first end portion of the tube is curved in an inverted U-shaped configuration that adapted to fit over the shoulder of a user standing in an erect position, so that the mid-portion of the tube extends downwardly from the first end portion ahead of the shoulder alongside the torso of the user to the second end portion of the tube, and so that the second end portion of the tube extends downwardly and rearwardly from the mid-portion alongside and adjacent the waist of the user in a position enabling the user to grip the second end portion while standing erect in order to steady the skis held within said ski mounting;

the ski mounting including first and second U-shaped brackets attached to the second end portion of the tube together with means in the form of stretchable first and second straps for cooperating with the brackets to hold the pair of skis on the second end portion in a position extending upwardly ahead of the user in an incline; and the first end portion of the tube being shaped so that it fits over the shoulder of the user sufficiently loose to enable the user to adjust the incline of the skis by pushing and pulling the second end portion of the robe forwardly and rearwardly relative to the user alongside the torso and adjacent the waist of the user and thereby rotate the tube relative to the shoulder of the user to a position in which the skis are inclined as desired.

9. A ski carrying device as recited in claim 8, further comprising means in the form of a cable attached to the tube for use in locking the device to a structure free of the device for carrying the pair of skis.

* * * * *